US007497749B2

(12) United States Patent
Takahashi et al.

(10) Patent No.: US 7,497,749 B2
(45) Date of Patent: Mar. 3, 2009

(54) OUTBOARD MOTOR ENGINE

(75) Inventors: Masanori Takahashi, Shizuoka-ken (JP); Satoshi Miyazaki, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/616,804

(22) Filed: Dec. 27, 2006

(65) Prior Publication Data

US 2007/0243960 A1 Oct. 18, 2007

(30) Foreign Application Priority Data

Apr. 14, 2006 (JP) ..... 2006-111966

(51) Int. Cl.
*B63H 21/21* (2006.01)

(52) U.S. Cl. ..... 440/85

(58) Field of Classification Search ..... 440/85, 440/113; 474/70, 198, 199
See application file for complete search history.

(56) References Cited

U.S. PATENT DOCUMENTS 4,043,623 A * 8/1977 Rausch et al. ..... 384/220
4,610,646 A * 9/1986 Walter et al. ..... 474/199
2001/0003080 A1* 6/2001 Morikami ..... 440/53
2004/0089257 A1* 5/2004 Takahashi et al. ..... 123/149 D

FOREIGN PATENT DOCUMENTS

JP 2004-147438 5/2004

* cited by examiner

*Primary Examiner*—Stephen Avila
(74) *Attorney, Agent, or Firm*—Knobbe Martens Olson & Bear LLP

(57) ABSTRACT

An outboard motor engine and a protruding member for use therewith are provided. The outboard motor engine can have a crankshaft whose first end can be connected to a driven member. The protruding member can extend outwardly in the axial direction from a second end of the crankshaft and rotate about an axis with the crankshaft. A flywheel can be fixed on a protruding end side of the protruding member by a tightening member. A drive pulley can be fixed on a base side of the protruding member on the axis. The tightening member can be oriented eccentrically with respect to the drive pulley in the axial direction of the protruding member.

23 Claims, 4 Drawing Sheets

OUTBOARD MOTOR ENGINE

CROSS-REFERENCE TO RELATED APPLICATIONS

The present application is based on and claims priority under 35 U.S.C. § 119 to Japanese Patent Application No. 2006-111966, filed on Apr. 14, 2006, the entire contents of which are expressly incorporated by reference herein.

BACKGROUND OF THE INVENTION

1. Field of the Invention

The present invention generally relates to engines, and more specifically to a uniquely configured crankshaft protruding member for an outboard motor engine. The crankshaft protruding member can support a flywheel and a drive pulley of the engine and allow the overall weight, number of parts, and general complexity of the engine to be reduced.

2. Description of the Related Art

A conventional outboard motor engine is disclosed in Japanese Patent Document No. JP-A-2004-147438 (hereinafter "JP '438"). The outboard motor engine of JP '438 is a four-stroke engine with a crankshaft that extends vertically through the engine with one end being connected to a propeller side, i.e. a driven member side, and another end being connected to a flywheel. A protruding member extends axially outward from the flywheel end of the crankshaft and rotates with the crankshaft. The protruding member has a protruding end side and a base side. The flywheel is fixed on the protruding end side of the protruding member by a tightening member. Further, a drive pulley is axially aligned with the crankshaft and fixed thereto on the base side of the protruding member. An endless drive belt engages the drive pulley in order to link a valve drive mechanism to the protruding member. The drive pulley is formed separately from the protruding member and is fitted and fixed on an outer face of the protruding member.

While the engine is running, intake and exhaust cam shafts of the valve drive mechanism are used to control the intake and exhausting of air. The valve drive mechanism is linked to a driven pulley of the valve drive mechanism via the drive pulley on the crankshaft and an endless drive belt. Rotational fluctuation of the crankshaft is suppressed and smooth drive is ensured by use of the flywheel, which is linked to the crankshaft. Therefore, a smooth drive force is transmitted through the crankshaft to the propeller side to drive the propeller.

JP '438 further teaches that screw holes are formed on the protruding member to fasten bolts of the tightening member. However, if it is required that the strength of the bolts be increased, which typically requires that the outer diameter of the bolts likewise increase, the screw holes formed in the protruding member—and the protruding member itself, and components thereof—must also be increased in size.

In general, the protruding member and the drive pulley fixed thereto are located in the same axial position along the protruding member. Thus, if the size or outer diameter of the protruding member increases, the size of the inner diameter of a drive pulley fitted on the outer face of the protruding member must also be enlarged to properly match the outer diameter of the protruding member.

Additionally, in some cases, the external size of the drive pulley must also be increased in order to achieve a larger inner diameter. In such a case, in order to preserve the speed reduction ratio between the drive pulley and a driven pulley linked to the drive pulley via the endless drive belt to a specific value (such as ½), the size of the outer diameter of the driven pulley must also be enlarged accordingly.

As a result, various parts of the engine, as well as the engine in general, become larger and heavier. This is undesirable, especially for an outboard motor engine.

Additionally, in the above-described engine, the drive pulley is typically formed separately from the protruding member. Thus, a further drawback of such an engine is that it requires an increased number of components which only complicates the structure of the engine.

SUMMARY OF THE INVENTION

An aspect of at least one of the embodiments disclosed herein includes the realization that the size and weight of an outboard motor engine should be reduced in order to enhance the drivability of an associated watercraft. Another aspect of at least one of the embodiments disclosed herein includes the realization that the structure of an engine preferably is simple.

In accordance with an embodiment, a protruding member is provided for use in an outboard motor engine. The protruding member can comprise an elongate shaft having a base side and a protruding end side.

The base side of the elongate shaft can be sized and configured to fixedly attach the elongate shaft to an end of a crankshaft of the engine with the elongate shaft being axially aligned therewith such that the elongate shaft rotates with the crankshaft about an axis thereof. The base side can also be configured to include a drive pulley thereon. The drive pulley can be axially alignable with the axis of the crankshaft.

The protruding end side of the elongate shaft can be sized and configured to attachably receive a part, such as a flywheel. The protruding end side can comprise at least one hole wherein a tightening member can be received to secure the part to the protruding end side of the elongate shaft for attaching the part thereto. At least a portion of the hole can be oriented eccentrically with respect to the drive pulley in the axial direction.

One aspect of the present invention involves an outboard motor engine comprising a crankshaft having a first end and a second end. The crankshaft defines an axis. The first end of the crankshaft is connected to a driven member. A protruding member has a base side and a protruding end side. The protruding member is axially aligned with and extends from the second end of the crankshaft. The base side of the protruding member is coupled for rotation to the second end of the crankshaft. A flywheel is mounted to the protruding end side of the protruding member. A tightening member couples the flywheel to the protruding end side of the protruding member. The protruding member comprises a drive pulley at the base side. The drive pulley is axially aligned with the axis of the crankshaft and is sized and configured to engage with a drive belt for linking a drive mechanism to the protruding member. The tightening member is radially offset from the drive pulley in the axial direction.

Another aspect of the present invention involves an outboard motor engine comprising a crankshaft having a first end, a second end and defining an axis. The first end is operatively connected to a driven member. A protruding member comprises a base side and a protruding end side. The protruding member is axially aligned with and extends from the second end of the crankshaft. The protruding member is formed separately from the crankshaft with the base side of the protruding member being secured for rotation with the second end of the crankshaft. A flywheel is attached at the protruding end side of the protruding member. A tightening member engages the flywheel and the protruding end side of the protruding member such that the flywheel is secured to the protruding member. A drive pulley is attached to the base side of the protruding member. The drive pulley is axially aligned with the axis of the crankshaft. The drive pulley engages a drive belt to link a drive mechanism to the protruding member. The tightening member and the drive pulley are radially offset from each other.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

FIGS. 1-4 illustrate embodiments of a motor engine and assembly comprising a crankshaft, a flywheel attached to the crankshaft, a protruding member, and a drive pulley. The embodiments disclosed herein are described in the context of a marine propulsion system of a watercraft because these embodiments have particular utility in this context. However, the embodiments and inventions herein can also be applied to other marine vessels, personal watercraft, boats, such as small jet boats, as well as other land and marine vehicles. It is to be understood that the embodiments disclosed herein are exemplary but non-limiting embodiments, and thus, the inventions disclosed herein are not limited to the disclosed exemplary embodiments.

Figure 1:
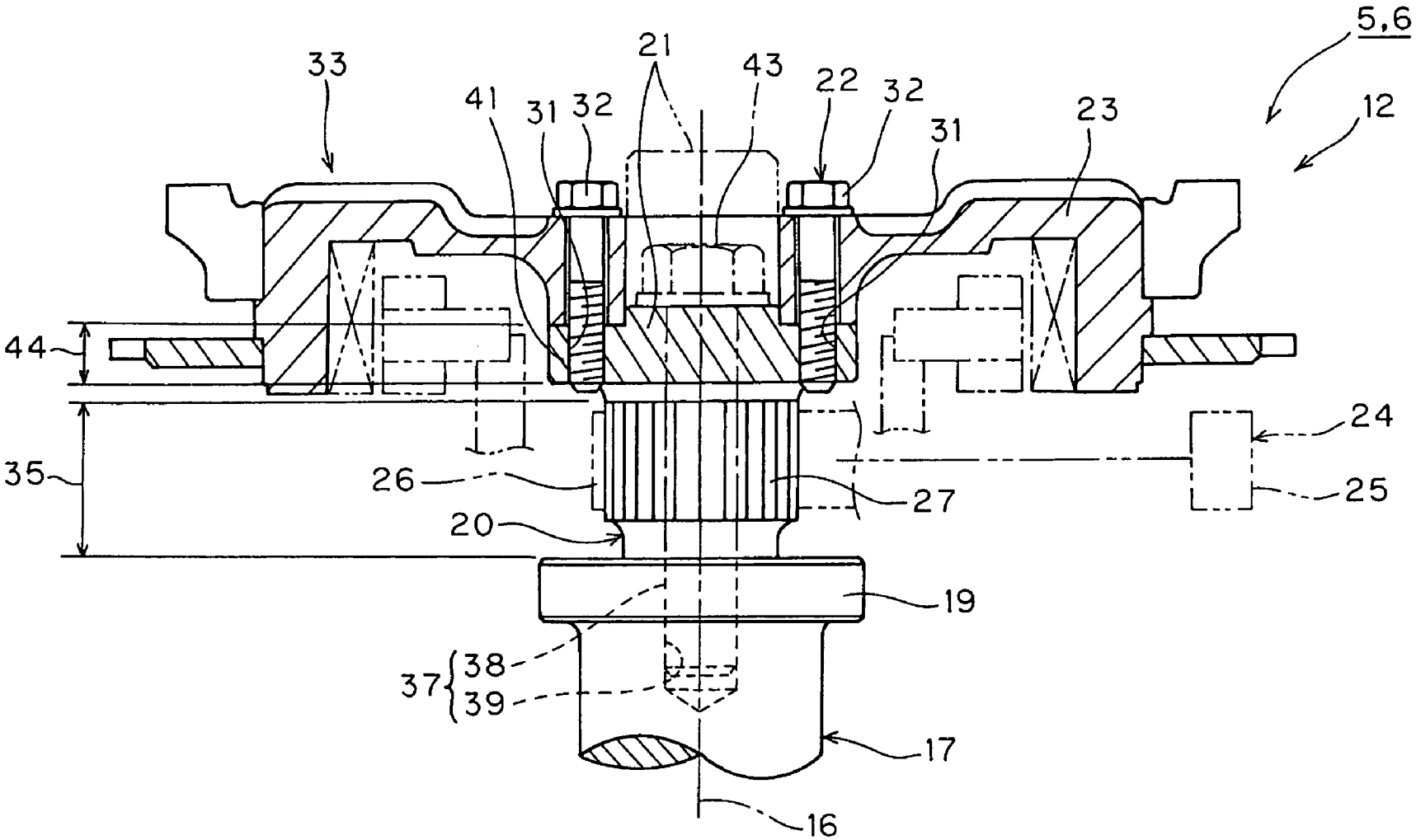
FIG. 1 is a partly enlarged sectional view of a portion of an outboard motor including a flywheel, a protruding member, and a drive pulley, in accordance with an embodiment.
Figure 2:
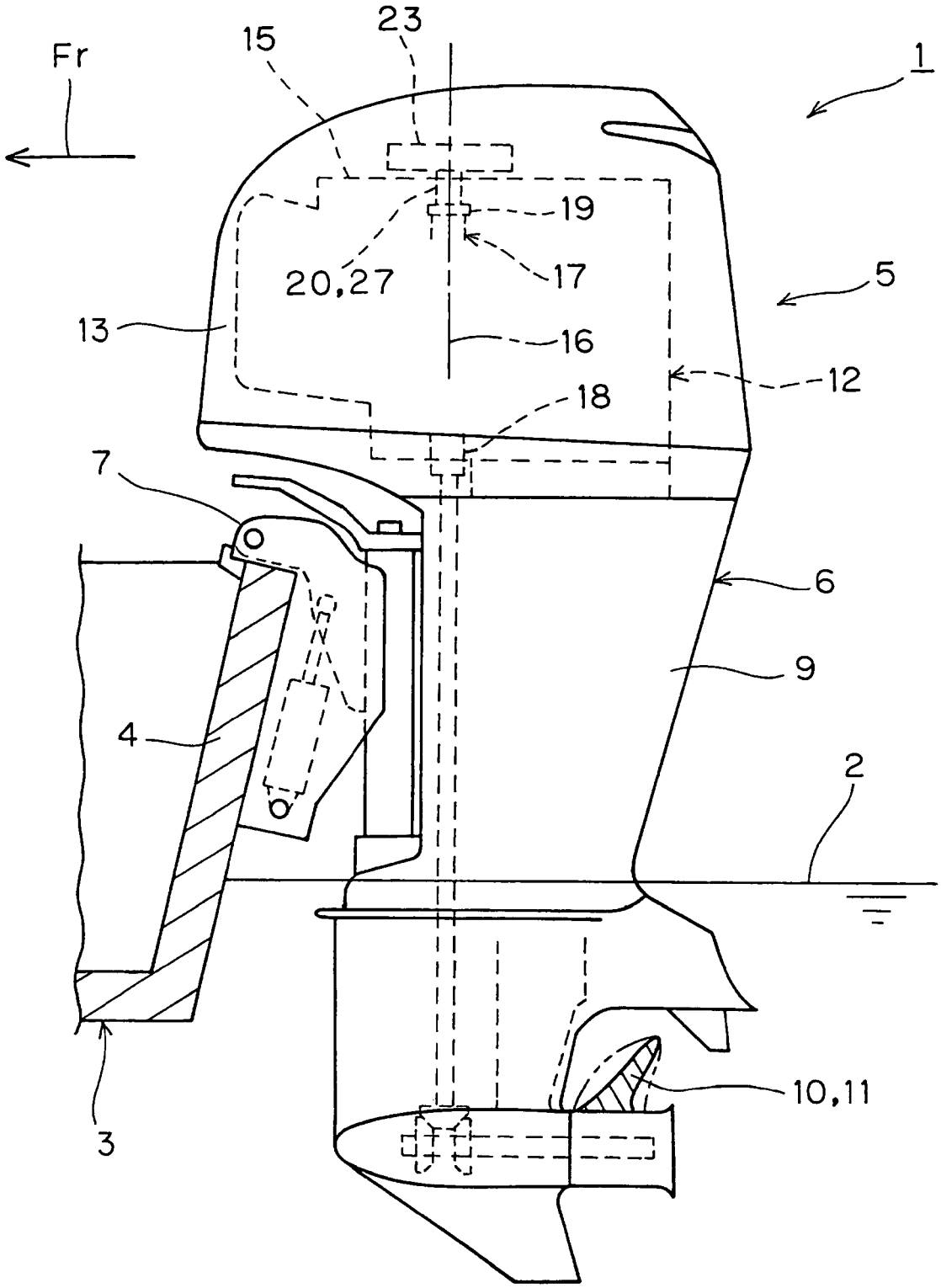
FIG. 2 is a side view of the outboard motor in accordance with an exemplary embodiment.

FIGS. 1-2 illustrate an exemplary watercraft 1 and an outboard motor 5 and assembly in accordance with an embodiment. The watercraft 1 illustrated in FIG. 2 is shown floating on the water surface 2, and an arrow Fr indicates a forward direction in which the boat 1 is propelled. The boat 1 can have a hull 3 and the outboard motor 5 can be supported by a stern 4 of the hull 3. The outboard motor 5 can include an outboard motor body 6 and a bracket 7 for supporting the outboard motor body 6 on the stem 4. The outboard motor body 6 can be located at the rear of the hull 3 for generating a propulsive force to drive the hull 3 ahead. Also, the bracket 7 can be configured such that the outboard motor body 6 is removable.

The outboard motor body 6 can include a case 9. The case 9 can be positioned generally vertically with the upper part supported by the bracket 7 and with the lower part under the water surface 2. A driven member 10, such as a propeller 11, can be supported on the lower part of the case 9. Further, an engine 12 can be supported in the upper part of the case 9 to drive the propeller 11. The engine 12 can be one of any type, size, or configuration of engines, and for example, can be a four-stroke internal combustion engine. Further, a cowling 13 can also be supported on the upper end of the case 9 to cover the engine 12. In some embodiments, the cowling 13 can be configured such that the cowling 13 can be opened and closed from the outside.

As shown in FIGS. 1-2, the engine 12 can include a crankcase 15 and a crankshaft 17. The crankcase 15 can be supported on the upper side of the case 9 and the crankshaft 17 can be supported on the crankcase 15. Although various configurations can be utilized, the crankcase 15 can be configured such that the crankshaft 17 is rotatable about a vertical axis 16. The crankshaft 17 can include first and second ends 18, 19. The first end 18 (i.e., a lower end) of the crankshaft 17 can be utilized to transfer rotation to the driven member 10. As the crankshaft 17 generates a drive force, the driven member 10 can be rotated to drive the watercraft 1.

In some embodiments, the engine 12 can be configured to include a protruding member 20 that can extend axially outward and/or upward from the second end (i.e., the upper end) 19 of the crankshaft 17. The protruding member 20 can be configured to include a protruding end side 21 and a base side 35. The protruding member 20 can be axially aligned with, and can extend from, the second end 19 of the crankshaft 17. The protruding end side 21 of the protruding member 20 is attachable to the second end 19 of the crankshaft 17 such that it will rotate with the crankshaft 17 about the axis 16. In some embodiments, the protruding member 20 can be formed as a shaft located on the axis 16 and with the diameter thereof being smaller than the diameter of the second end 19 of the crankshaft 17.

The protruding end side 21 of the protruding member 20 can be configured to receive a part 44, such as a flywheel 23. For example, the flywheel 23 can be fixed on an end face of the protruding end side 21 of the protruding member 20 by means of a tightening member 22. In this regard, the protruding member 20, as shown in FIG. 1, can be configured to include at least one or more holes 31. The holes 31 can be formed to correspond to the part 44 in order to facilitate attachment thereof to the protruding member 20. Preferably, the holes 31 can be oriented in parallel with respect to the axis 16 along the protruding end side 21 of the protruding member 20. In some configurations, the holes 31 can be threaded.

The tightening member 22 can comprise a plurality of bolts 32 or other fasteners that can be received into the holes 31 in order to attach the part 44 thereto. For example, bolts 32 can be arranged in a plurality of screw holes 31. Therefore, in this exemplary embodiment, the bolts 32 can be fastened to and extend through the flywheel 23. Nevertheless, it is contemplated that various other configurations and means can be used to fasten the part 44 to the protruding member 20.

In accordance with yet another embodiment, the protruding member 20 can be sized and configured to provide for the use of a drive pulley 27 thereon. As described further herein, the drive pulley 27 can be formed separately from and fixed to the protruding member 20 along the axis 16 or the drive pulley 27 can be integrally formed with the protruding member 20. Preferably, the drive pulley 27 can be configured such that an endless drive belt 26 can engage with the drive pulley 27 to link a driven pulley 25 of a drive mechanism, such as a valve drive mechanism 24, to the protruding member 20.

It is contemplated, as described herein, that at least a portion of the holes 31 can be oriented to be eccentric with respect to the drive pulley 27 in the axial direction of the protruding member 20. In this regard, at least a portion of the tightening member 22 can also be oriented to be eccentric with respect to the drive pulley 27 in the axial direction of the protruding member 20. For example, the tightening member 22 and/or the bolts 32 can be oriented to be axially eccentric with respect to the drive pulley 27.

In accordance with another embodiment, the endless drive belt 26 can be configured as a timing belt. Such a belt can include cogs or teeth to facilitate its meshing engagement. Likewise, the driven pulley 25 can be configured to mate with the drive belt 26. For example, cogs or teeth can be formed by machining on each peripheral surface of the driven pulley 25 and the drive pulley 27 to engage with the cogs or teeth of the endless drive belt 26. In addition, the flywheel 23 can be a component of a flywheel magneto 33.

In some embodiments, the protruding member 20 can be formed such that the drive pulley 27 is integrally formed with the protruding member 20 adjacent the base side 35 thereof. In this regard, the protruding member 20 can be machined to form the drive pulley 27. The drive pulley 27 can be machined from the protruding member 20 by machining each tooth of the outer surface of the drive pulley 27. However, alternative manufacturing methods can be performed that can result in the drive pulley 27 being integrally formed with the protruding member 20.

Such an embodiment can be beneficial because integral formation of the drive pulley 27 with the protruding member 20 reduces the number of parts of the engine 12. Further, such embodiments tend to more greatly reinforce the strength of the drive pulley 27 when compared to other embodiments in which the drive pulley 27 is formed separately from the protruding member 20. Therefore, relative to such other embodiments, the thickness and/or size of the integrally formed drive pulley 27 can be reduced to thereby decrease the size and weight of the engine 12 and nevertheless achieve the same strength.

In accordance with other embodiments, the protruding member 20 can be a member that is formed separately from the crankshaft 17. As shown in FIG. 1, the protruding member 20 can be fixed on the second end 19 of the crankshaft 17 utilizing a fixing member 37.

The fixing member 37 can be a tightening member and can include a bolt 38 disposed along the axis 16. The protruding member 20 and the crankshaft 17 can be configured such that the bolt 38 can extend through the protruding member into a screw hole 39 of the crankshaft 17. The bolt 38 can be axially aligned on the axis 16 and fastened in the screw hole 39, which can be formed on the second end 19 of the crankshaft 17. Thus, the bolt 38 can be utilized to fix the protruding member 20 on the second end 19 of the crankshaft 17.

The protruding end side 21 of the protruding member 20 can be formed to comprise a flange 41. The flange 41 can protrude radially outwardly from the base side 35 of the protruding member 20. The flange 41 can include the screw holes 31 formed therein. The flywheel 23 can be fixed on the flange 41 by the tightening member 22. In this manner, almost the entire body in the radial direction of the screw hole 31 of the tightening member 22 can be located outward from a peripheral surface of the drive pulley 27.

Additionally, the crankshaft 17 and integral members 20, 27 (including the protruding member 20) and the drive pulley 27 can be surface-treated to enhance strength, to reduce the likelihood of rust, and/or to provide abrasion resistance, such as that to the endless drive belt 26. In some embodiments, each of the crankshaft 17 and the integral members 20, 27 can be made of carbon steel. In such embodiments, the surface of only the drive pulley 27 is first plated and heat-treated. This step can be performed with or without the crankshaft 17 and the integral members 20, 27 assembled with the pulley 27. After this, the crankshaft 17 and the integral members 20, 27 can be nitrided integrally or separately.

As denoted by an alternate long and short dash line in FIG. 1, the fixing member 37 can have a bolt 43 fastened in the screw hole 39 in a manner in which the bolt 43 goes through the protruding member 20 on the axis 16.

As mentioned above, some embodiments can provide that the holes 31 and/or the tightening member 22 and the drive pulley 27 can be configured to be eccentric with respect to each other in the axial direction of the protruding member 20. Such a configuration can allow the drive pulley 27 to be sized and configured independently of the rest of the protruding member 20 and to also avoid any interference between the tightening member 22 and the drive pulley 27.

For example, in order to attach the part 44 to the protruding member 20, the protruding member 20 must have an appropriate configuration corresponding to that of the part 44. In accordance with an embodiment, the overall diameter and size of the protruding member 20 need not be increased should the outer diameter of the protruding end side 21 be increased to facilitate engagement with the part 44. Instead, the outer diameter of the protruding end side 21 can be configured substantially independently of the other portions of the protruding member 20. Thus, the outer diameter of the drive pulley 27 need not be affected by a modification in the dimension or configuration of the protruding end side 21 to accommodate a given part 44. Likewise, a modification in the dimension or configuration of the drive pulley 27 can be performed independently of the protruding end side 21. Such considerations provide valuable flexibility in the design and creation of the engine 12.

Consequently, a change in the protruding end side 21 need not substantially, if at all, affect the size of the outer diameter of the drive pulley 27. Thus, the drive pulley 27 and the driven pulley 25, which can be linked to the drive pulley 27 via an endless drive belt 26 with a specific speed reduction ratio, does not need to be modified in response to modification of the protruding end side 21. As a result, the size and weight of the engine 12 can be reduced, so that the engine can be beneficially used as an engine 12 for an outboard motor 5.

Furthermore, as opposed to embodiments wherein the protruding member 20 and drive pulley 27 are separately formed, other embodiments are possible that tend to have a fewer number of parts of the engine 12. By reducing the number of parts of the engine 12, the structure of the engine 12 can also be simplified.

As described above, the protruding member 20 can be formed separately from the crankshaft 17 and can be fixed to the crankshaft 17. This can be beneficial in some embodiments in order to facilitate machining of the drive pulley 27. For example, if the size of each outer diameter of the second end 19 of the crankshaft 17 and the part 44 in a protruding member 20 is larger than the outer diameter of the drive pulley 27, and if each cog on the outer surface of the drive pulley 27 is machined with a rotary tool, the second end 19 of the crankshaft 17 or the part 44 of the protruding member 20 may interfere with movement of the tool along its tool path during machining.

In order to reduce the likelihood of such interference, the protruding member 20 can be formed separately from the crankshaft 17. The aforementioned machining may therefore be done with the protruding member 20 being removed from the crankshaft 17. In this manner, the aforementioned machining can be done at least without the crankshaft 17 interfering.

Consequently, in some embodiments having the structure described above, the length of the protruding member 20 can be comparatively shorter than the length thereof when additional space is required along the protruding member 20 to facilitate the machining thereof. Machining requires that a workpiece be firmly and securely positioned relative to the machining head. Often, the workpiece can be clamped or otherwise secured, which requires that a portion of the workpiece be available to be placed in such a clamping device. In the present context, the protruding member 20 could otherwise be required to include an additional axial portion (as denoted reference numeral 45 in FIG. 3 below) to facilitate clamping of the protruding member 20 during machining. Thus, according to certain embodiments, the protruding member 20 can be machined without requiring the additional length, which would otherwise cause the engine 12 to be taller, larger, and/or heavier.

As mentioned previously, the protruding end side 21 of the protruding member 20 can be configured as a flange 41. In such an embodiment, the flange 41 can be of a desired size such that the base side 35 of the protruding member 20 and the size of the outer diameter of a drive pulley 27 fixed on the base side 35 are minimized. Such a feature of certain embodiments can reduce the size and weight of the engine 12 while helping to ensure that the protruding end side 21 of the protruding member 20 is sufficiently strong to securely fix the flywheel 23 thereto.

As described above, some embodiments can be configured such that the tightening member 22 comprises the bolt 32, which can be fastened in the screw hole 31 formed in the flange 41. In such embodiments, at least a portion of the hole 31 of the flange 41 can be oriented radially beyond a peripheral surface of the drive pulley 27. Thus, if a drill rotary tool is used to machine the screw hole 31 of the flange 41, there may be sufficient room and tool path clearance from the drive pulley 27 to facilitate operation and passage of the drill. Such an embodiment therefore tends to facilitate machining of the tightening member.

In other embodiments, the drive pulley 27 can be nitrided. Such a treatment can tend to enhance the strength of the drive pulley 27. Consequently, the thickness of the drive pulley 27 can be reduced, which reduces the size and weight of the engine 12.

In accordance with an embodiment, as denoted by a chain triple-dashed line in FIG. 1, the protruding end of the protruding end side 21 may pass through the flywheel 23 in the axial direction of the crankshaft 17 and be located outside of the outer surface of the flywheel 23.

In other embodiments, the protruding member 20 can be fixed on the crankshaft 17 by a press-fit construction. The fixing member 37 can comprise the bolt 38 and screw hole 39. The bolt 38 can be configured to be press-fit into the screw hole 39, which can be configured to receive the press-fit bolt via forcible insertion. Such a press-fit construction can facilitate the attachment of the protruding member 20 to the crankshaft 17.

Figure 3:
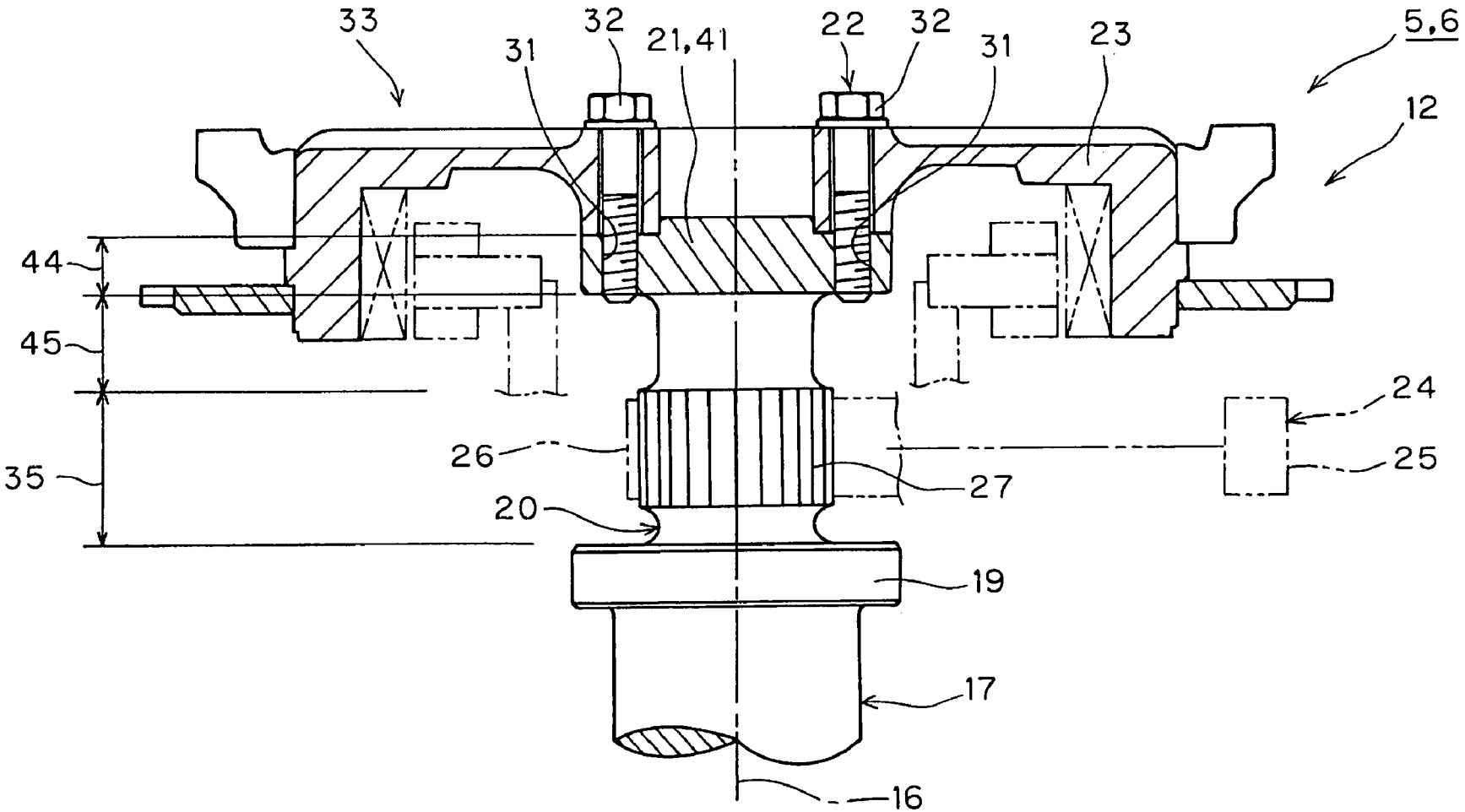
FIG. 3 is a partly enlarged sectional view of a portion of the outboard motor in accordance with another embodiment.
Figure 4:
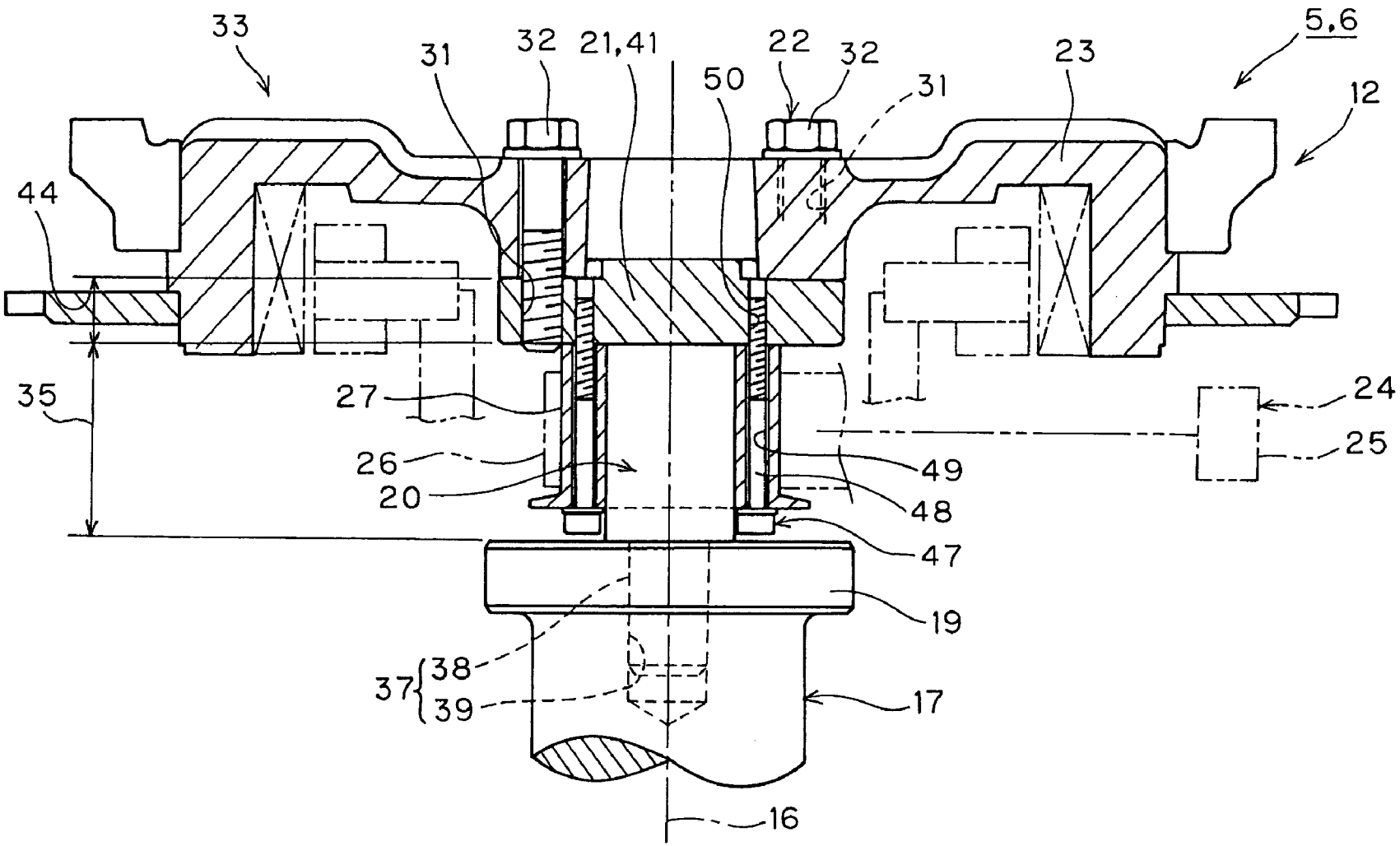
FIG. 4 is a partly enlarged sectional view of a portion of the outboard motor in accordance with yet another embodiment.

FIGS. 3-4 show additional embodiments. Each of these embodiments is similar to the embodiment illustrated in FIG. 1 in many aspects. Common reference numerals are given to these similar things in the drawings, so that repetitious explanations can be omitted. As discussed further below, structures of each part in these embodiments may be variously combined.

As illustrated in the embodiment shown in FIG. 3, the protruding member 20 can be integrally formed with the second end 19 of the crankshaft 17 to reduce the number of parts of the engine 12. The protruding end side 21 of the protruding member 20 can be axially extended, and an extended part 45 can be formed along the protruding member 20. The extended part 45 can be sized and configured to accommodate a clamp or other securing device therealong in order to facilitate the gripping of the protruding member 20 necessary to machine each tooth on the outer surface of the drive pulley 27. Thus, machining can be done easily and without the interference of the second end 19 of the crankshaft 17 or the flange 41 of the protruding end side 21.

In another embodiment, the protruding member 20 can be configured such that the diameter measured at cog grooves of the drive pulley 27 can be larger than the diameter of the extended part 45. Such a configuration can further facilitate machining of the protruding member 20 because the peripheral surface of the extended part 45 will not interfere with movement of the tool along a tool path during the machining of the cogs.

In some embodiments, the extended part 45 can be located closer to the flange 41 side than the drive pulley 27. Such a configuration can tend to axially separate the drive pulley 27 from the flange 41, with the extended part 45 being disposed intermediate the drive pulley 27 and the flange 41. As a result, the bolt 32 of the tightening member 22 disposed on the flange 41 will not likely interfere with the drive pulley 27. Thus, the length of the bolt 32 can be more loosely controlled without risking the above-mentioned interference.

Referring now to the embodiment illustrated in FIG. 4, the drive pulley 27, can be formed separately from and fitted onto the outer face of the base side 35 of the protruding member 20. The drive pulley 27 can be fixed on the base side 35 utilizing a tightening member 47. The tightening member 47 can comprise a bolt 48. The bolt 48 can be inserted into a bolt hole 49 that can be formed in the drive pulley 27 and in parallel with the axis 16. The bolt 48 can extend through the bolt hole 49 and into a screw hole 50 formed in a protruding end side 21 of the protruding member 20. Thus, the bolt 48 can be secured to the protruding member 20 and in turn secure the drive pulley 27 to the protruding member 20. In such embodiments, where the drive pulley 27 is formed separately from the protruding member 20, it is contemplated that the drive pulley 27 can be made of various materials, and is preferably made of sintered alloy.

The above-described embodiments, wherein the drive pulley 27 is formed separately from the protruding member 20, can also facilitate machining of the protruding member 20. For example, the drive pulley 27 can be removed from the protruding member 20 so that each cog on the outer surface of the drive pulley 27 can be machined with ease. Further, not only can the drive pulley 27 be removed from the protruding member 20 during machining, but the machining can be done with the protruding member 20 being removed from the crankshaft 17. In this manner, this machining can be made smoothly without the interference of the crankshaft 17 and/or the part 44 disposed on the protruding member 20.

In another embodiment, the base side 35 of the protruding member 20 can be forcibly inserted and fixed into the drive pulley 27. In yet another embodiment, the drive pulley 27 can also be configured to include an internal thread formed on an inner circumferential surface thereof, and the base side 35 of the protruding member 20 can be configured to include an external thread formed on a peripheral surface thereof. Thus, the drive pulley 27 can be fastened onto the protruding member 20 by threading the internal thread of the drive pulley 27 with the external thread of the base side 35 of the protruding member 20.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An outboard motor engine comprising:

a crankshaft having a first end and a second end, the crankshaft defining an axis, the first end of the crankshaft connected to a driven member, the second end of the crankshaft defining a crankshaft diameter;

a protruding member having a base side and a protruding end side, the protruding member being axially aligned with and extending from the second end of the crankshaft, the base side of the protruding member being coupled for rotation to the second end of the crankshaft;

a flywheel mounted to the protruding end side of the protruding member;

a tightening member coupling the flywheel to the protruding member at the protruding end side thereof; and the protruding member comprising a drive pulley at the base side, the drive pulley being axially aligned with the axis of the crankshaft and being sized and configured to engage with a drive belt for linking a drive mechanism to the protruding member, the protruding member defining a first diameter and the drive pulley defining a second diameter, wherein the tightening member is radially offset from the drive pulley in the axial direction and the first diameter and the second diameter are each less than the crankshaft diameter for reducing size and weight of the drive pulley and the drive mechanism.

2. The outboard motor of claim 1 wherein the drive pulley is formed separately from the protruding member.

3. The outboard motor of claim 1 wherein the drive pulley is formed integrally with the protruding member adjacent the base side thereof.

4. The outboard motor of claim 1 wherein the drive pulley and the protruding end side are axially separated by an extended part of the protruding member.

5. The outboard motor of claim 4 wherein the extended part is configured to have a diameter smaller than a diameter of the drive pulley.

6. The outboard motor of claim 1 wherein the protruding end side of the protruding member comprises a flange.

7. The outboard motor of claim 6 wherein the flange comprises a screw hole, the screw hole being oriented parallel with respect to the axis, and the tightening member comprising a bolt that is being sized and configured to be fastened within the screw hole of the flange, the screw hole of the flange being oriented radially beyond a peripheral surface of the drive pulley.

8. The outboard motor of claim 1 wherein the drive pulley is nitrided.

9. An outboard motor engine comprising:

a crankshaft having a first end, a second end and defining an axis, the first end being operatively connected to a driven member, the second end of the crankshaft defining a crankshaft diameter;

a protruding member comprising a base side and a protruding end side, the protruding member being axially aligned with and extending from the second end of the crankshaft, the protruding member defining a first diameter, the protruding member being formed separately from the crankshaft with the base side of the protruding member being secured for rotation with the second end of the crankshaft;

a flywheel attached at the protruding end side of the protruding member;

a tightening member fastening the flywheel and the protruding member at the protruding side thereof such that the flywheel is secured to the protruding member;

a drive pulley attached to the base side of the protruding member, the drive pulley being axially aligned with the axis of the crankshaft, the drive pulley defining a second diameter, the drive pulley engaging a drive belt to link a drive mechanism to the protruding member; and the tightening member and the drive pulley being radially offset from each other;

wherein the first diameter and the second diameter are each less than the crankshaft diameter for reducing size and weight of the drive pulley and the drive mechanism.

10. The outboard motor of claim 9 wherein the protruding end side of the protruding member comprises a flange.

11. The outboard motor of claim 10 wherein the flange comprises a screw hole formed therein, the screw hole being oriented parallel with respect to the axis, the tightening member comprising a bolt that is sized and configured to be fastened within the screw hole of the flange, and the screw hole of the flange being oriented radially beyond a peripheral surface of the drive pulley.

12. The outboard motor of claim 9 wherein the drive pulley is nitrided.

13. A protruding member for use in an outboard motor engine to engage with a drive belt for linking a drive mechanism to the protruding member, the protruding member comprising an elongate solid shaft having a base side and a distally extending protruding end side, the base side of the elongate shaft being sized and configured to fixedly attach the elongate shaft to an end of a crankshaft with the elongate shaft being axially aligned therewith such that the elongate shaft rotates with the crankshaft about an axis thereof, the base side being further configured to include a drive pulley thereon, the protruding member defining a first diameter and the drive pulley defining a second diameter, the first diameter and the second diameter each being less than a diameter of the crankshaft for reducing size and weight of the drive pulley and the drive mechanism, the drive pulley being axially alignable with the axis of the crankshaft, the protruding end side of the elongate shaft being sized and configured to attachably receive a part, the protruding end side comprising at least one hole wherein a tightening member can be received to secure the part to the protruding end side of the elongate shaft for attaching the part thereto, at least a portion of the hole being oriented eccentrically with respect to the drive pulley in the axial direction.

14. The protruding member of claim 13 wherein the elongate shaft is formed separately from the crankshaft.

15. The protruding member of claim 13 wherein the drive pulley is formed separately from the elongate shaft.

16. The protruding member of claim 13 wherein the drive pulley is formed integrally with the elongate shaft adjacent the base side thereof.

17. The protruding member of claim 13 wherein the part attachable thereto is a flywheel.

18. The protruding member of claim 13 wherein the drive pulley is sized and configured to engage with a drive belt for linking a drive mechanism to the protruding member.

19. The protruding member of claim 13 wherein the protruding end side of the elongate shaft comprises a flange.

20. The protruding member of claim 19 wherein the flange includes the hole formed therein and wherein the tightening member comprises a bolt being sized and configured to be fastened within the hole of the flange, the hole of the flange being oriented radially beyond a peripheral surface of the drive pulley.

21. The outboard motor of claim 1 wherein the second diameter of the drive pulley is an inner diameter of the drive pulley.

22. The outboard motor of claim 9 wherein the second diameter of the drive pulley is an inner diameter of the drive pulley.

23. The protruding member of claim 13 wherein the second diameter of the drive pulley is an inner diameter of the drive pulley.

* * * * *

UNITED STATES PATENT AND TRADEMARK OFFICE

CERTIFICATE OF CORRECTION

PATENT NO. : 7,497,749 B2
APPLICATION NO. : 11/616804
DATED : March 3, 2009
INVENTOR(S) : Takahashi et al.

It is certified that error appears in the above-identified patent and that said Letters Patent is hereby corrected as shown below:

At column 3, line 44, please change "stem" to -- stern --.

Signed and Sealed this

Twenty-fifth Day of August, 2009

David J. Kappos

David J. Kappos
*Director of the United States Patent and Trademark Office*